United States Patent [19]

Belinko et al.

[11] Patent Number: 4,963,247

[45] Date of Patent: Oct. 16, 1990

[54] HYDROCRACKING OF HEAVY OIL IN PRESENCE OF ULTRAFINE IRON SULPHATE

[75] Inventors: Keith Belinko, Nepean; Chandra P. Khulbe; Anil K. Jain, both of Oakville, all of Canada

[73] Assignee: Petro-Canada Inc., Mississauga, Canada

[21] Appl. No.: 403,861

[22] Filed: Sep. 7, 1989

[30] Foreign Application Priority Data

Sep. 12, 1988 [CA] Canada ..... 577161

[51] Int. Cl.[5] ..... C10G 1/06; C10G 47/02

[52] U.S. Cl. ..... 208/112; 208/108; 208/107; 208/106

[58] Field of Search ..... 208/108, 112

[56] References Cited

U.S. PATENT DOCUMENTS

| | | | |
|---|---|---|---|
| 2,572,061 | 10/1951 | Sellers | 196/53 |
| 3,151,057 | 9/1964 | Schuman et al. | 208/418 |
| 3,755,137 | 8/1973 | Schuman | 208/10 |
| 3,775,286 | 11/1973 | Mukherjee et al. | 208/420 |
| 3,775,296 | 11/1973 | Chervenak et al. | 208/108 |
| 4,065,514 | 12/1977 | Bartley et al. | 208/112 |
| 4,214,977 | 7/1980 | Ranganathan et al. | 208/108 |
| 4,260,472 | 4/1981 | Eisenlohr et al. | 208/8 |
| 4,299,685 | 11/1981 | Khulke et al. | 208/112 |
| 4,399,023 | 8/1983 | Suzuka et al. | 208/112 |
| 4,435,280 | 3/1984 | Rancjananthan et al. | 208/112 |
| 4,437,972 | 3/1984 | Derbyshire et al. | 208/8 |
| 4,455,218 | 6/1984 | Pymock et al. | 208/108 |
| 4,486,293 | 12/1984 | Garg | 208/10 |
| 4,495,306 | 1/1985 | Budahn et al. | 502/185 |
| 4,508,616 | 4/1985 | Larraui et al. | 208/112 |
| 4,557,822 | 12/1985 | Bearden et al. | 208/112 |
| 4,581,127 | 4/1986 | Varahese | 208/108 |
| 4,675,097 | 6/1987 | Patel et al. | 208/112 |
| 4,756,819 | 7/1988 | Bon Squet et al. | 208/112 |
| 4,828,675 | 5/1989 | Sawyer et al. | 208/61 |

*Primary Examiner*—Helane Myers

[57] ABSTRACT

A hydroconversion process is described in which a feed slurry comprising a heavy hydrocarbon oil and an iron compound additive is contacted with a hydrogen-containing gas in a hydroconversion zone at hydroconversion conditions to convert at least a portion of said oil to lower boiling products. The process is characterized by the use of an iron compound having particle sizes of less than 45 μm, preferably with at least 50 wt % of particles of less than 5 μm.

9 Claims, 1 Drawing Sheet

HYDROCRACKING OF HEAVY OIL IN PRESENCE OF ULTRAFINE IRON SULPHATE

This invention relates to the treatment of hydrocarbon oils and, more particularly, to the hydrotreating of heavy hydrocarbon oils in the presence of very finely divided iron compounds.

BACKGROUND OF THE INVENTION

Hydrocracking processes for the conversion of heavy hydrocarbon oils to light and intermediate naphthas of good quality for reforming feedstocks, fuel oil and gas oil are well known. These heavy hydrocarbon oils can be such material as petroleum crude oils, atmospheric tar bottoms products, vacuum tar bottoms products, heavy cycle oils, shale oils, coal-derived liquids, crude oil residua, topped crude oils and heavy bituminous oils extracted from oil sands. Of particular interest are oils which contain a large portion of material boiling above 524° C. equivalent atmospheric boiling point.

As the reserves of conventional crude oils decline, these heavy oils must be upgraded to meet the demands. In this upgrading, the heavier material is converted to lighter fractions and most of the sulphur, nitrogen and metals must be removed.

This has been done either by a coking process, such as delayed or fluidized coking, or by a hydrogen addition process such as thermal or catalytic hydrocracking. The distillate yield from the coking process is about 70 wt % and this process yields a significant amount of low-BTU gas and coke as byproduct.

Work has also been done on an alternative processing route involving hydrogen addition at high pressures and temperatures and this has been found to be quite promising. In thermal hydrocracking, the major problem is coke or solid deposition in the reactor, especially when operating at relatively low pressure and this can result in costly shut-downs. Higher pressure reduces reactor fouling but plant operations at high pressure involve higher capital and operating costs.

It has been well established that mineral matter present in the feedstock plays an important role in coke deposition. Chervenak et al., U.S. Pat. No. 3,775,296 shows that feed containing high mineral content (3.8 wt %) has less tendency to form coke in the reactor than feed containing low mineral matter (<1 wt %). The addition of coke carriers was proposed in Schuman et al. U.S. Pat. No. 3,151,057, who suggested the use of "getters" such as sand, quartz, alumina, magnesia, zircon, beryl or bauxite. It has been shown in Ternan et al., Canadian Patent No. 1,073,389 and Ranganathan et al., U.S. Pat. No. 4,214,977 that the addition of coal and coal-based catalyst results in the reduction of coke deposition during hydrocracking.

In U.S. Pat. No. 3,775,286 a process is described for hydrogenating coal in which the coal was either impregnated with hydrated iron oxide, or dry, hydrated iron oxide powder was physically mixed with powdered coal. Canadian Patent No. 1,202,588 describes a process for hydrocracking heavy oils in the presence of an additive in the form of dry mixture of coal and an iron salt, such as iron sulphate.

Dry grinding of coal and/or drying of coal impregnated with iron salt and/or drying of coal and iron compound mixture is a hazardous and difficult procedure. To overcome this problem, a procedure was described in Khulbe et al, U.S. patent application Ser. No. 304,557, filed Feb. 1, 1989 to form an additive by grinding a coal and an iron compound mixture under oil. Although this procedure avoids the problems associated with wet impregnation and subsequent drying of coal particles, still the problems associated with the handling of coal and coal dust exist.

SUMMARY OF THE INVENTION

This invention relates to a hydroconversion process in which a feed slurry comprising a heavy hydrocarbon oil and a single component iron compound additive is contacted with a hydrogen-containing gas in a hydroconversion zone at under conversion conditions to convert at least a portion of the oil to lower boiling products and thereby produce a hydroconverted oil. The iron compound is present in the feed slurry in an amount up to 5% by weight, based on the oil and may be selected from a wide range of iron materials, e.g. steel mill wastes such as electric arc furnace flue dust, alumina industry wastes, etc. An iron salt, such as iron sulphate, is particularly preferred. A particularly important consideration according to this invention is that the iron compound must be of a very small particle size, e.g. less than 45 μm with a major portion preferably less than 10 μm. It is particularly advantageous to have at least 50% of the particles of less than 5 μm.

The process of the invention substantially prevents the formation of carbonaceous deposits in the reaction zone. These deposits, which may contain quinoline and benzene insoluble organic material, mineral matter, metals, sulphur and little benzene-soluble organic material will hereinafter be referred to as "coke" deposits.

The use of a single component finely ground iron compound according to this invention has many advantages. For instance, additive preparation costs are reduced, coal handling hazards are avoided and the solids content of the by-product pitch is reduced, while the pitch conversion and liquid yields are improved.

The process of this invention is particularly well suited for the treatment of heavy oils having at least 10%, preferably at least 50%, by weight of which boils above 524° C. and which may contain a wide boiling range of materials from naphtha through kerosene, gas oil and pitch. It can be operated at quite moderate pressure, preferably in the range of 3.5 to 24 MPa, without coke formation in the hydrocracking zone. The reactor temperature is typically in the range of 350° to 600° C., with a temperature of 400° to 450° C. being preferred. The LHSV is typically in the range of 0.1 to 3.0 $h^{-1}$.

Although the hydrocracking can be carried out in a variety of known reactors of either up or down flow, it is particularly well suited to a tubular reactor through which feed and gas move upwardly. The effluent from the top is preferably separated in a hot separator and the gaseous stream from the hot separator can be fed to a low temperature-high pressure separator where it is separated into a gaseous stream containing hydrogen and less amounts of gaseous hydrocarbons and a liquid product stream containing light oil product.

According to a preferred embodiment, the particles of iron compound are mixed with a heavy hydrocarbon oil feed and pumped along with hydrogen through a vertical reactor. The liquid-gas mixture from the top of the hydrocracking zone can be separated in a number of different ways. One possibility is to separate the liquid-gas mixture in a hot separator kept between 200°–470°

C. and at the pressure of the hydrocracking reaction. The heavy hydrocarbon oil product from the hot separator can either be recycled or sent to secondary treatment.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber and the scrubbed hydrogen may be recycled as part of the hydrogen feed to the hydrocracking process. The hydrogen gas purity is maintained by adjusting scrubbing conditions and by adding make up hydrogen.

The liquid stream from the low temperature-high pressure separator represents the light hydrocarbon oil product of the present process and can be sent for secondary treatment.

At hydrocracking conditions, the metal salts are converted to metal sulphides. Some of the iron compound additive and all of the metal sulphides will end up in the 524° C.+ pitch fraction. However, since this is a very cheap additive, it need not be recovered and can be burned or gasified with the pitch.

BRIEF DESCRIPTION OF THE DRAWING

For a better understanding of the invention, reference is made to the accompanying drawing which illustrates diagrammatically a preferred embodiment of the present invention.

Figure 1:
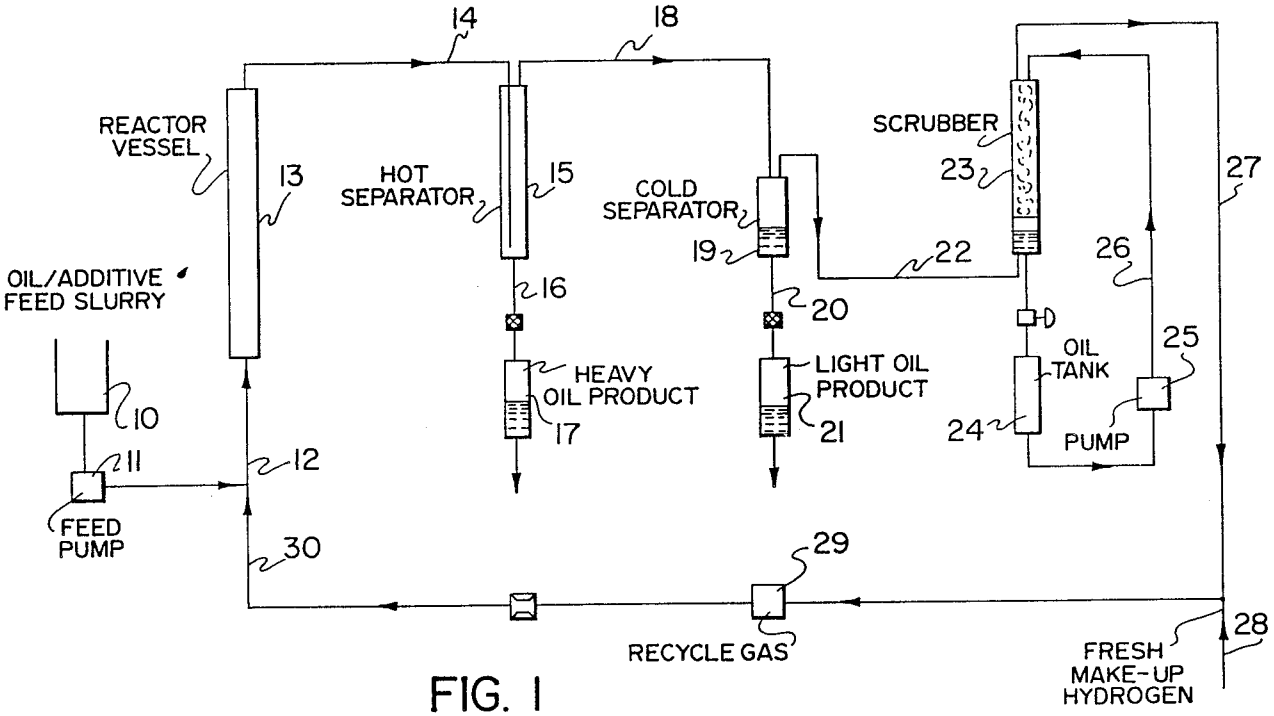
FIG. 1 is a schematic flow diagram showing a hydrocracking process.

In the hydrocracking process as shown in FIG. 1, the iron salt additive is mixed together with a heavy hydrocarbon oil feed in a feed tank 10 to form a slurry. This slurry is pumped via feed pump 11 through inlet line 12 into the bottom of an empty tower 13. Recycled hydrogen and make up hydrogen from line 30 is simultaneously fed into the tower through line 12. A gas-liquid mixture is withdrawn from the top of the tower through line 14 and introduced into a hot separator 15. In the hot separator the effluent from tower 13 is separated into a gaseous stream 18 and a liquid stream 16. The liquid stream 16 is in the form of heavy oil which is collected at 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen rich stream 22 is passed through a packed scrubbing tower 23 where it is scrubbed by means of a scrubbing liquid 24 which is cycled through the tower by means of pump 25 and recycle loop 26. The scrubbed hydrogen rich stream emerges from the scrubber via line 27 and is combined with fresh make up hydrogen added through line 28 and recycled through recycle gas pump 29 and line 30 back to tower 13.

Preferred embodiments of this invention are illustrated in a series of non limiting examples. For these examples, a series of additives were prepared some of which are representative of the prior and some of which are representative of the present invention. The additives used are as follows:

1. Tray dried additive.

This is a conventional coal impregnated with iron sulphate and tray dried to form dried particles. Such a product is described in U.S. Pat. No. 4,214,977.

2. Oil co-grind additive.

This is a slurry prepared by grinding a coal and an iron compound mixture under oil as described in U.S. patent application Ser. No. 304,557.

3. As received −100 mesh $FeSO_4$.

This is a commercial iron sulphate which has been passed through a 100 mesh screen.

4. Dry grind demo plant $FeSO_4$.

The as received $FeSO_4$ was subjected to dry grinding in a stirred hammer mill.

5. Wet lab grind $FeSO_4$.

The as received $FeSO_4$ was subjected to wet grinding under oil in a stirred ball mill.

6. Wet grind $FeSO_4$.

The as received $FeSO_4$ was subjected to wet grinding under oil in a stirred ball mill.

7. As received −325 mesh $FeSO_4$

This is a commercial iron sulphate which has been passed through a 325 mesh screen.

8. Ultrafine wet ground $FeSO_4$

The as received $FeSO_4$ was subjected to two-stage wet grinding under oil in a stirred ball mill.

The particle size distributions of the above additives are shown in Table 1 below:

TABLE I

ADDITIVE PARTICLE SIZE DISTRIBUTION

| | | Additive No. | | | | | | | |
|---|---|---|---|---|---|---|---|---|---|
| | | 1 Tray Dried Additive | 2 Oil/Co-Grind Additive | 3 As Received −100 mesh $FeSO_4$ | 4 Dry Grind Demo Plant $FeSO_4$ | 5 Wet Lab Grind $FeSO_4$ | 6 Wet Grind $FeSO_4$ | 7 As Received −325 Mesh $FeSO_4$ | 8 Ultra-Fine $FeSO_4$ |
| Composition | | | | | | | | | |
| Coal wt % | | 70 | 70 | — | — | | — | — | — |
| $FeSO_4.H_2O$ wt % | | 30 | 30 | 100 | 100 | 100 | 100 | 100 | |
| Particle size, vol % | | | | | | | | | |
| −3 | μm | 0.5 | — | 0.4 | 2.6 | — | | 0.9 | 85.5 |
| 3–5 | μm | 4.0 | 2.9 | 1.0 | 9.5 | 50.1 | 11.6 | 2.2 | 9.0 |
| 5–10 | μm | 14.2 | 9.7 | 6.4 | 32.3 | 36.4 | 34.1 | 14.2 | 5.5 |
| 10–20 | μm | 26.4 | 24.4 | 22.5 | 46.6 | 9.3 | 38.4 | 50.0 | — |
| 20–45 | μm | 27.8 | 49.3 | 14.2 | 8.1 | 2.2 | 15.8 | 31.5 | — |
| 45–150 | μm | 31.6 | 13.7 | 55.5 | 0.9 | 2.2 | 0.1 | 1.2 | — |
| Average | μm | 25 | 27 | 55 | 11 | <5 | 11 | 16.5 | 1.3 |

TABLE I-continued

| ADDITIVE PARTICLE SIZE DISTRIBUTION | | | | | | | | |
|---|---|---|---|---|---|---|---|---|
| | | Additive No. | | | | | | |
| | | 1 Tray Dried Additive | 2 Oil/Co-Grind Additive | 3 As Received −100 mesh $FeSO_4$ | 4 Dry Grind Demo Plant $FeSO_4$ | 5 Wet Lab Grind $FeSO_4$ | 6 Wet Grind $FeSO_4$ | 7 As Received −325 Mesh $FeSO_4$ | 8 Ultra-Fine $FeSO_4$ |
| $\bar{d}$ | μm | 16 | 19 | 26 | 8.5 | 5.5 | 9.5 | 13.6 | 0.6 |

$$d = \frac{100}{\Sigma \frac{x}{dm}}$$

d = average particle size
dm = mid point of PSD range, μm
x = amount of sample in each PSD range %

EXAMPLE 1

A series of comparative tests were conducted using certain of the additives described above. These tests were carried out on a continuous flow bench scale system with a 300 cc reactor as shown in FIG. 1. The tests were designed to operate the unit at steady state for 40 hours and the effectiveness of the additive to reduce solid deposition was determined by the total problem-free operating time and the amount of solids deposited in the reactor at the end of the run. A run was considered successful if less than 10 grams of solids were deposited in the reactor.

For these tests, the feed stocks used were vacuum tower bottoms from Interprovincial Pipeline crude oil and from light Arabian crude oil. The feed stocks had the following properties:

TABLE 2

| PROPERTIES OF THE FEED | | | |
|---|---|---|---|
| | | IPL VTB | LAVB VTB |
| Sp. Gravity | | 1.019 | 1.019 |
| Gravity | °API | 7.5 | 7.4 |
| C | wt % | 86.4 | 85.02 |
| H | wt % | 10.2 | 10.17 |
| N | wt % | 0.47 | 0.26 |
| S | wt % | 2.45 | 4.34 |
| Ash | wt % | 0.04 | 0.03 |
| PI | wt % | 20.2 | 13.55 |
| TI | wt % | 0.7 | 0.01 |
| CCR/RCR | wt % | (RCR) 20.4 | 22.3 |
| Metals | | | |

TABLE 2-continued

| PROPERTIES OF THE FEED | | | |
|---|---|---|---|
| | | IPL VTB | LAVB VTB |
| V | ppm | 102 | 102 |
| Ni | ppm | 55 | 25 |
| Fe | ppm | 124 | 28 |

PI = Pentane Insoluble
TI = Toluene Insoluble
CCR = Conradson Carbon Residue
RCR = Ramsbottom Carbon Residue The amounts of additive, feed stock, the processing conditions and the results obtained are all set out in Table 3 below:

TABLE 3

| BENCH SCALE HYDROCRACKER RESULTS | | | | | | | | | | |
|---|---|---|---|---|---|---|---|---|---|---|
| Test # | | 1 | 2 | 3 | 4 | 5 | 6 | 7 | 8 | 9 |
| Operating Conditions | | | | | | | | | | |
| Feed | | IPL VTB | IPL VTB | IPL VTB | IPL VTB | IPL VTB | LAVB | IPL VTB | IPL VTB | IPL VTB |
| Additive Type | | #1 | #1 | #2 | #2 | #3 | #3 | #6 | #6 | #5 |
| Particle Size | μm | 75 | 75 | 75 | 75 | 150 | 150 | 75 | 75 | <1.00 |
| Concentration | wt % on feed | 0.5 | 1.0 | 1.0 | 1.0 | 0.40 | 0.33 | 0.3 | 0.6 | 0.30 |
| Fe % | wt % on feed | 0.045 | 0.09 | 0.09 | 0.09 | 0.12 | 0.10 | 0.09 | 0.18 | 0.09 |
| Temperature | °C. | 450 | 450 | 450 | 450 | 440 | 450 | 450 | 450 | 450 |
| Pressure | MPa | 11.8 | 11.8 | 11.8 | 11.8 | 11.8 | 11.8 | 11.8 | 11.8 | 11.8 |
| LHSV | $h^{-1}$ | 0.55 | 0.55 | 0.55 | 0.55 | 0.55 | 0.55 | 0.55 | 0.55 | 0.55 |
| Duration | h | 38 | 40 | 40 | 40 | 13 | 6 | 7 | 40 | 40 |
| Results | | | | | | | | | | |
| Pitch Conver. | wt % | 81.9 | 78.4 | 75.5 | 81.2 | 70.4 | 73.0 | 72.3 | 81.6 | 85.3 |
| Gas Yield | wt % | 5.1 | 4.7 | 4.4 | 5.0 | 3.9 | 4.0 | 4.1 | 5.0 | 5.5 |
| Naphtha | wt % | 21.2 | 21.5 | 14.8 | 17.1 | 22.9 | 18.9 | 20.6 | 19.4 | 21.7 |
| LGO | wt % | 29.2 | 26.3 | 25.3 | 26.6 | 22.9 | 27.5 | 24.8 | 27.3 | 29.9 |
| VGO | wt % | 28.0 | 26.7 | 32.5 | 33.3 | 23.2 | 26.6 | 24.9 | 30.9 | 29.6 |
| Pitch | 25% | 16.5 | 20.8 | 23.0 | 18.0 | 27.1 | 23.0 | 25.6 | 17.4 | 13.2 |
| End of the Run | | | | | | | | | | |
| Coke in the Reactor | g | 27 | 2 | 2 | 1 | 129 | 155 | 167 | 1 | 3 |
| Test Result | | F | P | P | P | F | F | F | P | P |

F = Fail
P = Pass

The above results clearly show the advantages of the present invention. Thus, Tests 1 and 2 show that 1 wt % of conventional tray dried iron sulphate impregnated coal is required for a successful run. Tests 3 and 4 show that an addition of 1 wt. % of an iron-coal cogrind gives a successful result. In Tests 5 and 6 the iron sulphate simply screened to 325 mesh failed even at an increased iron concentration. In Tests 7 and 8 iron sulphate with a top particle size of 45 μm were successful at an iron concentration of 0.18%. Test 9 again used iron sulphate with a top particle size of 45 μm, but in this case about 50% of the particles were less than 5 μm. This additive was especially effective with an iron concentration of only 0.09 wt %, giving a better pitch conversion than was obtained with any of the other additives and leaving only a very small amount of residue in the reactor.

EXAMPLE 2

For this test a reactor similar to the one used in Example 1 was used. However, it was equipped with a 1 liter reactor and it included sampling facilities to take reactor content samples during operation.

A set of experiments was conducted to determine the effect of additive particle size on the amount of TIOR (Toluene Insoluble Organic Residue) in the reactor during operation. Reactor content samples were taken at predetermined time intervals and were analyzed for TI (Toluene Insolubles) and ash, from which the TIOR was calculated.

The operating conditions for the reactor are shown in Table 4 below:

TABLE 4

| HYDROCRACKER OPERATING CONDITIONS | | | | |
|---|---|---|---|---|
| Test No. | | 1 | 2 | 3 |
| Feed | | IPPL VTB | IPPL VTB | IPPL VTB |
| LHSV | $h^{-1}$ | 0.55 | 0.55 | 0.55 |
| Pressure | MPa | 13.89 | 13.89 | 13.89 |
| Temperature | °C. | 430–450 | 430–450 | 430–445 |
| Additive | | #3 | #4 | #4 |
| Type | | | | |
| Conc. | % of Feed | 1.5 | 1.5 | 0.7 |
| Fe | % of Feed | 0.5 | 0.5 | 0.23 |
| Top Size | μm | 150 | 150 | 150 |
| Average | μm | 50 | 8 | 8 |
| Total Run Time | h | 193 | 224 | 190 |
| Solid Coke in reactor at end of the run | g | 106 | (continued to another run series, 10 g) | (continued to another run series - 16 g) |

The performance of a hydrocracking process depends upon the amount of TIOR in the reactor, as this material converts to a so-called "mesophase" which is the primary coke precursor and ultimately to coke. As the amount of TIOR in the reactor increases, coke formation in the reactor also increases ultimately shutting down the unit. Thus, an efficient additive must reduce the rate of TIOR formation during operation, thereby allowing the unit to operate at high severity and/or for long time periods without encountering operational problems.

The TIOR results for different additive amounts and different operational temperatures are shown in Table 5 below:

TABLE 5

| HYDROCRACKER RESULTS | | | | |
|---|---|---|---|---|
| Test No. | | 1 | 2 | 3 |
| T = 430° C. | | | | |
| Pitch Conv. | wt % | 50 | 48 | 54 |
| Duration | h | 72 | 24 | 72 |
| TIOR Reactor Bottom | wt % | 7.9 | 2.3 | 5.6 |
| Middle | wt % | 2.5 | 1.2 | 3.6 |
| TI Reactor Bottom | wt % | 18.1 | 6.6 | 8.1 |
| Middle | wt % | 4.1 | 2.8 | 5.1 |
| Sample Rate | | | | |
| Total | wt % of feed | 4.5 | 2.7 | 1.8 |
| Bottom | wt % of feed | 1.9 | 1.3 | 1.0 |
| T = 440° C. | | | | |
| Pitch Conv. | wt % | 65 | 72 | 70 |
| Duration | h | 60 | 63 | 70 |
| TIOR Reactor Bottom | wt % | 12.8 | 3.3 | 18.6 |
| Middle | wt % | 5.8 | 2.2 | 6.1 |
| TI Reactor Bottom | wt % | 30.2 | 8.8 | 22.6 |
| Middle | wt % | 10.4 | 5.0 | 8.1 |
| Sample Rate | | | | |
| Total | wt % of feed | 3.8 | 1.8 | 2.0 |

TABLE 5-continued

| HYDROCRACKER RESULTS | | | | |
|---|---|---|---|---|
| Test No. | | 1 | 2 | 3 |
| Bottom | wt % of feed | 1.9 | 1.0 | 1.1 |
| T = 445° C. | | | | |
| Pitch Conv. | wt % | 77 | 68 | 72 |
| Duration | h | 29 | 69 | 28 |
| TIOR Reactor Bottom | wt % | 15.5 | 8.0 | 20.2 |
| Middle | wt % | 5.0 | 4.1 | |
| TI Reactor Bottom | wt % | 27.5 | 13.8 | 24.5 |
| Middle | wt % | 8.0 | 7.5 | 7.0 |
| Sample Rate | | | | |
| Total | wt % of feed | 4.0 | 1.7 | 2.3 |
| Bottom | wt % of feed | 3.5 | 0.9 | 1.9 |
| T = 450° C. | | | | |
| Pitch Conv. | wt % | 77 | 79 | |
| Duration | h | 26 | 59 | |
| TIOR Reactor Bottom | wt % | 16.6 | 12.8 | |
| Middle | wt % | 5.3 | 4.6 | |
| TI Reactor Bottom | wt % | 27.7 | 19.9 | |
| Middle | wt % | 7.9 | 10.2 | |
| Sample Rate | | | | |
| Total | wt % of feed | 6.0 | 2.4 | |
| Bottom | wt % of feed | 4.6 | 1.6 | |

From Table 5 it will be seen that at all operating conditions the amount of TIOR in the reactor for Test No. 2 was less than that for Test No. 1, although the liquid withdrawal rate for Test No. 2 was much less than Test No. 1, which would result in higher accumulation and higher amounts of TIOR in the reactor. Test no. 3 shows the effects of reducing additive concentration and fine additive particle size. The amount of TIOR in the reactor in Test No. 3 was more than for Test No. 2 but it was much less than for Test No. 1. This clearly demonstrates that the additive performance to reduce coke formation in the reactor improves with the reduction in particle size.

EXAMPLE 3

The purpose of this experiment was to compare a conventional iron/coal additive with the finely ground iron sulphate of the present invention. The tests were carried out using the same reactor as in Example 2 and in addition to analyzing reactor content for TI and ash, the TI samples were also analyzed microscopically to determine the size and concentration of mesophase and coke. The operating conditions and analytical results are listed in Table 6 below:

TABLE 6

| HPDU HYDROCRACKING RUN SUMMARY | | | | | | | |
|---|---|---|---|---|---|---|---|
| Temperature | | 440 | | 445 | | 455 | |
| Case # | °C. | 1 | 2 | 1 | 2 | 1 | 2 |
| Liquid Feed | | IPL VTB | IPL VTB | IPL VTB | IPL VTB | IPL VTB | IPL VTB |
| Pressure | MPA | 13.8 | 13.8 | 13.8 | 13.8 | 13.8 | 13.8 |
| Gas Rate | $Lmin^{-1}$ | 23 | 23 | 23 | 23 | 23 | 23 |
| LHSV | $h^{-1}$ | 0.55 | 0.55 | 0.55 | 0.55 | 0.55 | 0.55 |
| Additive Type | | Type #2 | Type #8 | | | | |
| Additive | wt % | 3.4 | 1.7 | 3.4 | 1.7 | 3.4 | 1.7 |
| Ash | wt % | 0.85 | 0.85 | 0.85 | 0.85 | 0.85 | 0.85 |
| Pitch Conversion | wt % | 73 | 72 | 78 | 77 | 84 | 85 |
| Solid Deposition | g | — | — | — | — | 72 | 50 |
| Reactor Bottom | | | | | | | |
| TI | wt % | 19.1 | 7.7 | 20.0 | 15.5 | 24.8 | 23.6 |
| TIOR | wt % | 10.4 | 4.9 | 10.3 | 11.3 | 13.3 | 17.4 |
| Reactor Middle | | | | | | | |
| TI | wt % | 14.1 | 7.2 | 17.4 | 11.0 | 22.1 | 17.0 |
| TIOR | wt % | 8.4 | 4.6 | 10.0 | 6.8 | 11.8 | 9.7 |

TABLE 6-continued

| HPDU HYDROCRACKING RUN SUMMARY | | | | | | | |
|---|---|---|---|---|---|---|---|
| Temperature | | 440 | | 445 | | 455 | |
| Case # | °C. | 1 | 2 | 1 | 2 | 1 | 2 |
| Reactor Liquid Sampling Rate | | | | | | | |
| Total | % Feed | 1.8 | 1.4 | 1.4 | 1.2 | 1.4 | 1.7 |
| Bottom | % Feed | 0.8 | 0.9 | 1.0 | 0.7 | 1.0 | 1.2 |

From the above table, it can be seen that the amount of TI and TIOR in the reactor is greatly reduced when the very fine grain iron sulphate additive is used.

The microscopic results are shown in Table 7 below:

TABLE 7

| SUMMARY OF MICROSCOPY DATA | | |
|---|---|---|
| Additive | Test No. 1 Co-Ground | Test No. 2 Ultrafine |
| Reactor | No new mesophase until 450° C. | Mesophase seen at 440, 445 and 450° C. |
| Bottom | At 450° C., new meso was <10 μm and <1% concentration | Size increased from 10 μm at 440° C. to 25 μm at 450° C. Concentration approx. 1%. |
| Reactor | New mesophase (<10 μm, <1%) detected at 440 and 445° C. Concentration increased to 1-2% at 450° C. | Very low concentration of new mesophase (10 μm) at 440 and 445° C. 0.1% meso at 450° C. |

From the above results, it will be seen that no mesophase appeared at the bottom of the reactor at temperatures lower than 450° C. However, at the middle of the reactor, the mesophase appeared at lower temperatures and concentration increased to about 2%.

For Test No. 2, mesophase was seen at the bottom of the reactor at 440° C. and grew in size to 25 μm. At the middle of the reactor, the mesophase appeared at 440° C. but the concentration was low even at 450° C. The overall concentration of mesophase for Test No. 2 was much less than for Test No. 1, indicating a superior performance for the additive consisting of finely ground iron sulphate.

Since in a vertical upflow reactor, larger additive particles settle at the bottom of the reactor and smaller particles flow to the upper zones of the reactor, it will be seen that in Test No. 1 the larger additive particles collected at the bottom and thereby prevented growth of mesophase by coalescence.

We claim:

1. In a hydroconversion process in which a feed slurry comprising a heavy hydrocarbon oil and an iron compound additive is contacted with a hydrogen-containing gas in a hydroconversion zone at hydrocracking conditions at a temperature of 350°-600° C. and LHSV of 0.1 to 3.0 $h^{-1}$ to convert at least a portion of said oil to lower boiling products, the improvement which comprises utilizing as said additive a material consisting solely of an iron compound having particle sizes of less than 45 μm.

2. A process according to claim 1 wherein at least 50 wt % of the particles are less than 10 μm.

3. A process according to claim 2 wherein at least 50 wt % of the particles are less than 5 μm.

4. A process according to claim 1, 2 or 3 wherein the iron compound is iron sulphate.

5. A process according to claim 1, 2 or 3 wherein the iron compound is waste material from a steel mill or alumina plant.

6. The process according to claim 1, 2 or 3 wherein the iron compound is a naturally occurring ore.

7. A process according to claim 1, 2 or 3 wherein the iron compound is present in an amount of less than 5% by weight, based on feed.

8. A process according to claim 1, 2 or 3 wherein the heavy hydrocarbon oil contains at least 10% by weight of material boiling about 524° C.

9. A process according to claim 1, 2 or 3 wherein the iron compound additive consists solely of a mixture of iron compounds.

* * * * *